US009673512B2

(12) United States Patent
Lin

(10) Patent No.: US 9,673,512 B2
(45) Date of Patent: Jun. 6, 2017

(54) ANTENNA ASSEMBLY AND WIRELESS COMMUNICATION DEVICE EMPLOYING SAME

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 117 days.

(21) Appl. No.: 14/677,748

(22) Filed: Apr. 2, 2015

(65) Prior Publication Data

US 2016/0164192 A1 Jun. 9, 2016

(30) Foreign Application Priority Data

Dec. 5, 2014 (CN) ..... 2014 1 0730629

(51) Int. Cl.

| | |
|---|---|
| ***H01Q 1/24*** | (2006.01) |
| ***H01Q 9/42*** | (2006.01) |
| ***H01Q 21/30*** | (2006.01) |
| ***H01Q 5/314*** | (2015.01) |

(52) U.S. Cl.

CPC ..... *H01Q 1/243* (2013.01); *H01Q 5/314* (2015.01); *H01Q 9/42* (2013.01); *H01Q 21/30* (2013.01)

(58) Field of Classification Search

None

See application file for complete search history.

(56) References Cited

U.S. PATENT DOCUMENTS

2014/0266923 A1* 9/2014 Zhou ..... H01Q 5/35 343/702

2015/0091766 A1* 4/2015 Ali ..... H01Q 1/243 343/750

* cited by examiner

*Primary Examiner* — Robert Karacsony

(74) *Attorney, Agent, or Firm* — Steven Reiss

(57) ABSTRACT

An antenna assembly includes a first radiating portion, a second radiating portion, a third radiating portion, and a switch circuit. The switch circuit is electrically connected between the second radiating portion and the third radiating portion. The switch circuit includes a plurality of branch circuit with different impedances. The first radiating portion and the second radiating portion are electrically coupled and configured to operate at a first frequency band; the first radiating portion, the third radiating portion, the switch circuit, and the second radiating portion are electrically coupled and configured to operate at a second frequency band; the switch circuit is configured to adjust a resonance mode of the antenna assembly by switching to different impedances. A wireless communication device employing the antenna assembly is also provided.

14 Claims, 8 Drawing Sheets

ANTENNA ASSEMBLY AND WIRELESS COMMUNICATION DEVICE EMPLOYING SAME

FIELD

The subject matter herein generally relates to an antenna assembly and a wireless communication device employing the antenna assembly.

BACKGROUND

Most wireless communication devices may include metal components designed to surround an antenna assembly, which may generate an electromagnetic shield around the antenna assembly. In addition, the antenna assembly needs to meet wide frequency band requirement. This limitation makes it difficult to design a smaller size to meet the miniaturization trend of the wireless communication devices and to decrease interference to the metal components.

BRIEF DESCRIPTION OF THE DRAWINGS

Implementations of the present technology will now be described, by way of example only, with reference to the attached figures.

DETAILED DESCRIPTION

Figure 1:
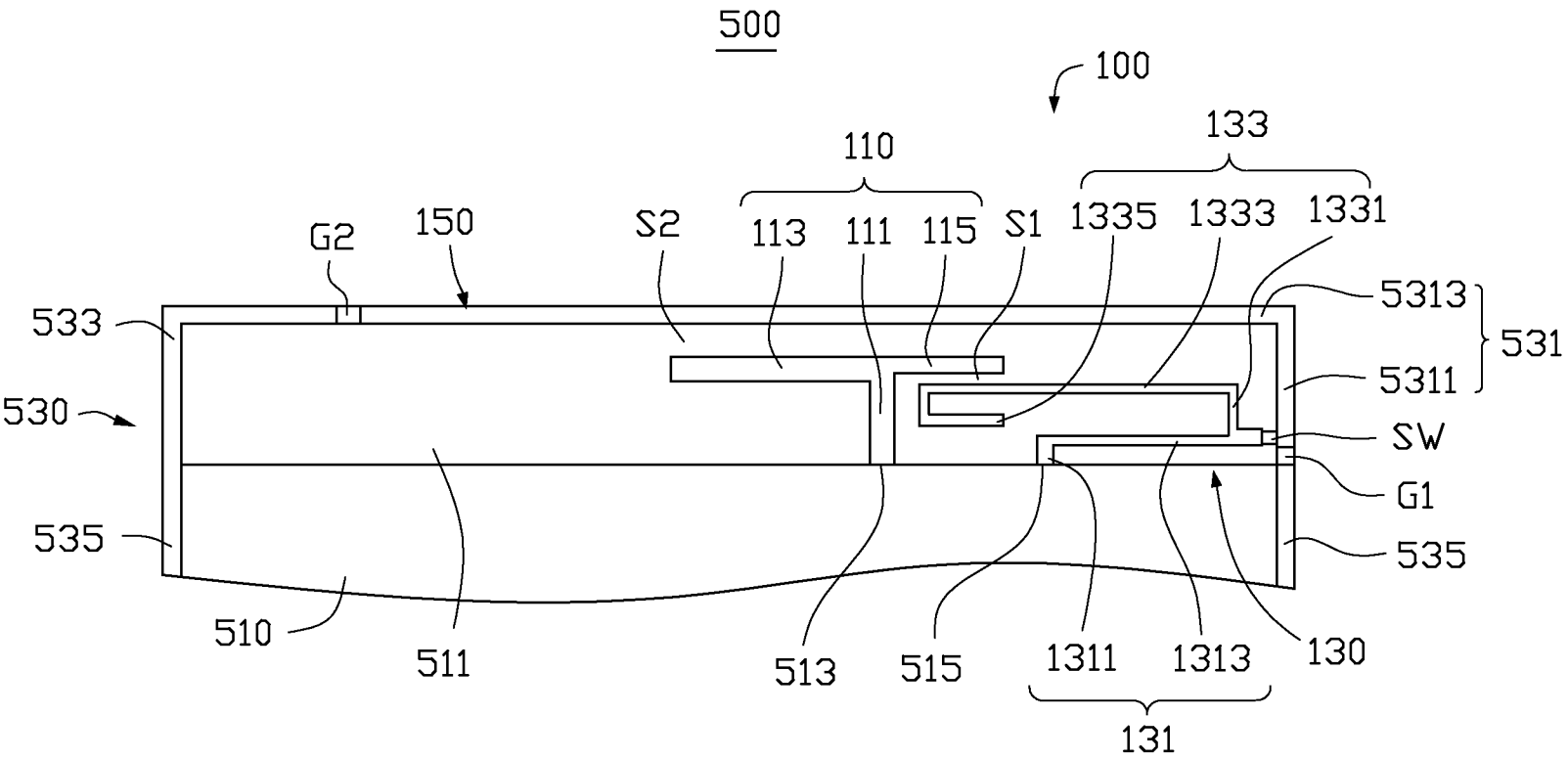
FIG. 1 is a partial diagrammatic view of a first of a wireless communication device employing an antenna assembly.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape or other word that substantially modifies, such that the component need not be exact. The term "comprising," when utilized, means "including, but not necessarily limited to"; it specifically indicates open-ended inclusion or membership in the so-described combination, group, series and the like.

FIG. 1 illustrates at least one embodiment of an antenna assembly 100 applied in a wireless communication device 500. The wireless communication device 500 can be a mobile phone, a tablet computer, or a PDA for transmitting and receiving wireless signals.

The wireless communication device 500 includes a base board 510 and a metal frame 530 surrounding the base board 510. The base board 510 defines a clearance zoon 511 on one end. The base board 510 includes a feeding point 513 and a ground point 515 adjacent to the clearance zoon 511. The feeding point 513 is electrically connected to a radio frequency transceiver circuit of the wireless communication device 500 and configured to feed in signals for the antenna assembly 100. The ground point 515 is electrically connected to a ground of the base board 510 to provide grounding signals to the antenna assembly 100. The metal frame 530 defines a first gap G1 and a second gap G2 to divide the metal frame 530 into a first antenna frame 531, a second antenna frame 533, and a third antenna frame 535. The first gap G1 and the second gap G2 are filled with nonconductive material. In at least one embodiment, the first gap G1 closes to the ground point 515 and adjacent to an edge of the clearance zoon 511 facing the base board 510. The second gap G2 is adjacent to an edge of the clearance zoon 511 away from the base board 510.

The antenna assembly 100 includes a first radiating portion 110, a second radiating portion 130, a third radiating portion 150, and a switch circuit SW. The first radiating portion 110 is capable of coupling to the second radiating portion 130 and the third radiating portion 150. The switch circuit SW is electrically connected between the second radiating portion 130 and the third radiating portion 150 to adjust a resonance mode of the antenna assembly 100.

The first radiating portion 110 is substantially a T-shaped monopole antenna and includes a first radiating section 111, a second radiating section 113, and a third radiating section 115. The first radiating section 111 is substantially perpendicularly connected to an edge of the clearance zoon 511 facing the base board 510 and is electrically connected to the feeding point 513. The second radiating section 113 is perpendicularly connected to an end of the first radiating section 111 away from the feed point 513. The third radiating section 115 is perpendicularly connected to an end of the first radiating section 111 away from the feed point 513. The second radiating section 113 and the third radiating section 115 extend in opposite direction from the first radiating section 111. The second radiating section 113 has a greater width than that of the third radiating section 115. In at least one embodiment, the second radiating section 113 is configured to stimulate a first high frequency mode, and the third radiating section 115 is configured to stimulate a low frequency mode and a second high frequency mode.

The second radiating portion 130 includes a first radiating member 131 and a second radiating member 133. The first radiating member 131 is substantially L-shaped and includes a shorter section 1311 and a longer section 1313. The shorter section 1311 is perpendicularly connected to the edge of the clearance zoon 511 facing the base board 510 and electrically connected to the ground point 515. The longer section 1313 extends towards the first gap G1 from the shorter section 1311. The second radiating member 133 includes a first connecting section 1331, a second connecting section 1333, and a third connecting section 1335. The first connecting section 1331 is substantially perpendicular to an end of the longer section 1313 away from the shorter section 1311. The second connecting section 1333 is substantially perpendicular to an end of the first connecting section 1331 away from the longer section 1313. The second connecting section 1333 extends towards the first radiating section 111 and parallel to the third radiating section 115, and a first slot Si is formed between the second connecting section 1333 and the third radiating section 115. The third connecting section 1335 is substantially L-shaped, one end of the third connecting section 1335 is perpendicularly connected to the an end of the second connecting section 1333 close to the first radiating section 111, and the other end extends towards the first connecting section 1331 and parallel to the second connecting section 1333. Thus, the first radiating member 131 and the second radiating member 133 cooperatively form a non-closed circuit.

The third radiating portion 150 includes the first antenna frame 531 and the second antenna frame 533. The first antenna frame 531 is substantially L-shaped and includes a first frame section 5311 and a second frame section 5313 perpendicularly connected to the first frame section 5311. An end of the first frame section 5311 is adjacent to the first gap G1, and an end of the second frame section 5313 is adjacent to the second gap G2. The second frame section 5313, the second radiating section 113, and the third radiating section 115 enclose a second slot S2. The second antenna frame 533 is substantially L-shaped, one end of the second antenna frame 533 is spaced from the first antenna frame 531 via the second gap G2, and the other end extends to the edge of the clearance zoon 511 facing the base board 510. In at least one embodiment, the second antenna frame 533 is configured to stimulate a third high frequency mode. By adjusting a position of the second gap G2 to change a length of the second antenna frame 533, a central frequency in the third high frequency mode may decrease according to a length increase of the second antenna frame 533.

Figure 2:
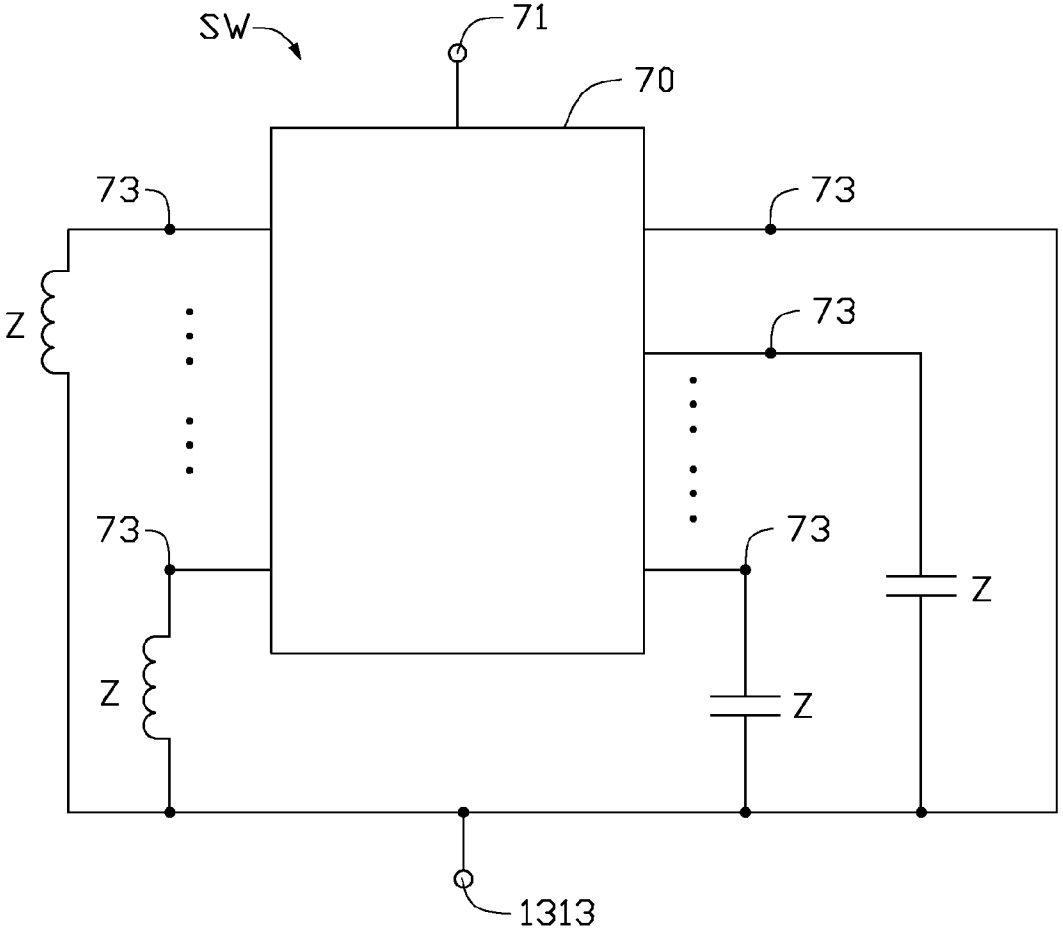
FIG. 2 is a circuit diagram of the antenna assembly of FIG. 1.

FIG. 2 illustrates that the switch circuit SW includes a switching element 70 and at least one reactance Z. The switching element 70 includes an input terminal 71 and at least one output terminal 73. The input terminal 71 is electrically connected to an end of the first frame section 5311 close to the first gap G1. One end of the at least one reactance Z is electrically connected the output terminal 73, and the other end is electrically connected to an end of the longer section 1313 close to the first gap G1. In at least one embodiment, the at least one reactance Z can be a capacitor, an inductor, a resistor, or a combination of the capacitor, the inductor, and the resistor in serial or in parallel. The at least one output terminal 73 and the longer section 1313 can be electrically connected via conducting line to shorten the circuit. The third radiating portion 150 can be electrically connected to the second radiating portion 130 via short circuit, the reactance Z, or the reactance Z combinations by switching the switching element 70 to different output terminals 73 to adjust the resonance mode of the antenna assembly 100 according to different impedances.

Figure 3:
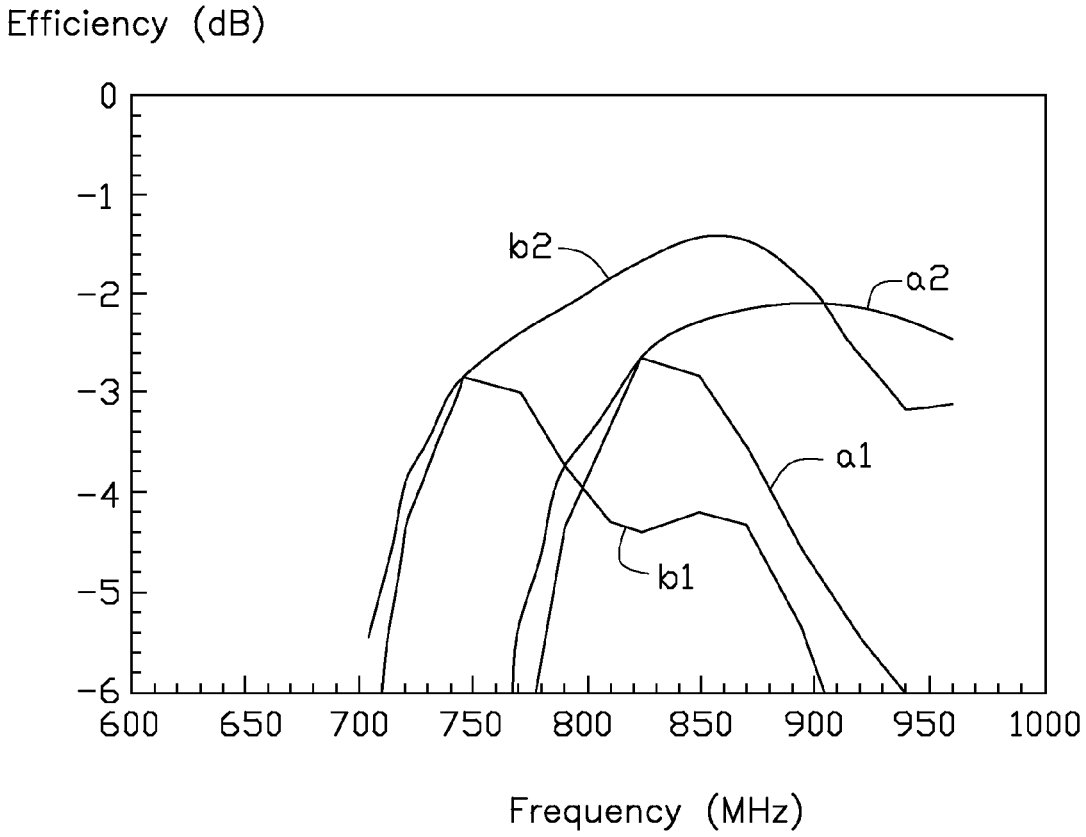
FIG. 3 is a first radiating efficiency diagram of the antenna assembly of FIG. 1.

FIG. 3 illustrates a total efficiency and a radiating efficiency of the antenna assembly 100 in the low frequency mode, when the switch circuit SW switches to a capacitor with 3 pF and a capacitor with 6 pF to connect the second radiating portion 130 and the third radiating portion 150. Line a1 represents a total efficiency of the antenna assembly 100 in the low frequency mode when the switch circuit SW switches to the capacitor with 3 pF; line a2 represents a radiating efficiency of the antenna assembly 100 in the low frequency mode when the switch circuit SW switches to the capacitor with 3 pF. Line b1 represents a total efficiency of the antenna assembly 100 in the low frequency mode when the switch circuit SW switches to the capacitor with 6 pF; line b2 represents a radiating efficiency of the antenna assembly 100 in the low frequency mode when the switch circuit SW switches to the capacitor with 6 pF. FIG. 3 further illustrates that the radiating efficiency of the antenna assembly 100 in the low frequency mode when the switch circuit SW switches to the capacitor with 3 pF and 6 pF is greater than −3 dB. Hence, the low frequency resonance mode of the antenna assembly 100 can be adjusted by switching to different capacitors.

The antenna assembly 100 can work as follow: the first radiating portion 110 feeds in current from the feeding point 513, and couples to the second radiating portion 130 and the third radiating portion 150 via the first slot 51 and the second slot S2, respectively. The second radiating portion 130 conducts the current to ground via the first radiating member 1311, the second radiating member 1313, and the ground point 515. Therefore, the feeding point 513, the first radiating portion 110, the second radiating portion 130, and the ground point 515 form a first circuit to word at a first frequency band. The third radiating portion 150 conducts the current to ground via switch circuit SW, the first radiating member 131, and the ground point 515. Therefore, the feeding point 513, the first radiating portion 110, the third radiating portion 150, the switch circuit SW, the first radiating member 131, and the ground point 515 form a second circuit to work at a second frequency band. In at least one embodiment, the first radiating portion 110 coupled to the second radiating portion 130 and the third radiating portion 150 can be adjusted by adjusting a width of the first slot 51 and the second slot S3 and a length of the third radiating section 115.

Figure 4:
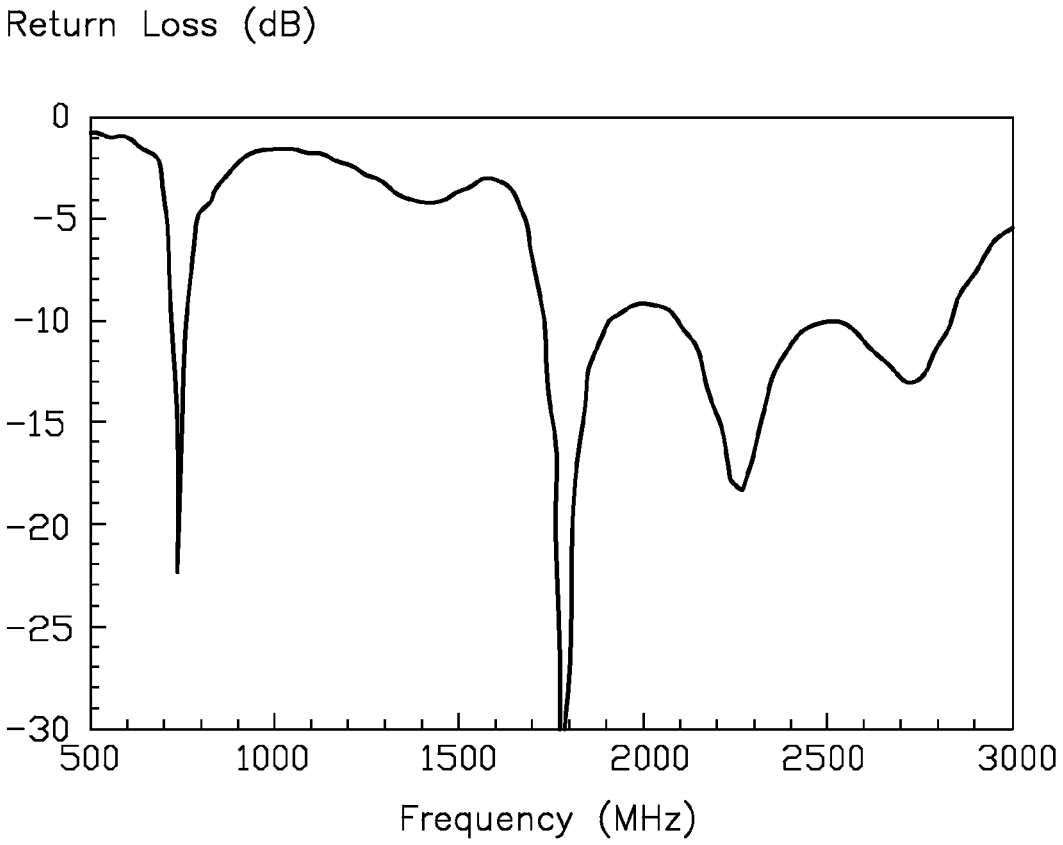
FIG. 4 a return loss (RL) diagram of an antenna assembly of FIG. 1.

FIG. 4 illustrates that a return loss diagram of the antenna assembly 100 when the wireless communication device 500 is designed with a size of 68×130×7 mm, a size of the clearance zoon 511 is 66×8.5 mm, a length of the second radiating section 113 is 12 mm, a length of the third radiating section 115 is 6.5 mm, a total length of the second connecting section 1333 and the third connecting section 1335 is 26.5 mm, a length of the first antenna frame 531 is 64 mm, a length of the second antenna frame 533 is 20 mm, a width of the first gap G1 and the second gap G2 is 1.5 mm, a width of the first slot S1 is 0.6 mm, a width of the second slot S2 is 2 mm, and the switch circuit SW is connected to the capacitor of 6 pF. In these parameters, the antenna assembly 100 can work in a high frequency mode of about 1710-2690 MHz and in a low frequency mode of about 704-787 MHz, and a frequency band of about 850/900 MHz can be achieved by adjusting the switch circuit SW. Hence, the antenna assembly 100 can work at different frequency bands for the wireless communication device 500 to meet different communication requirements.

Figure 5:
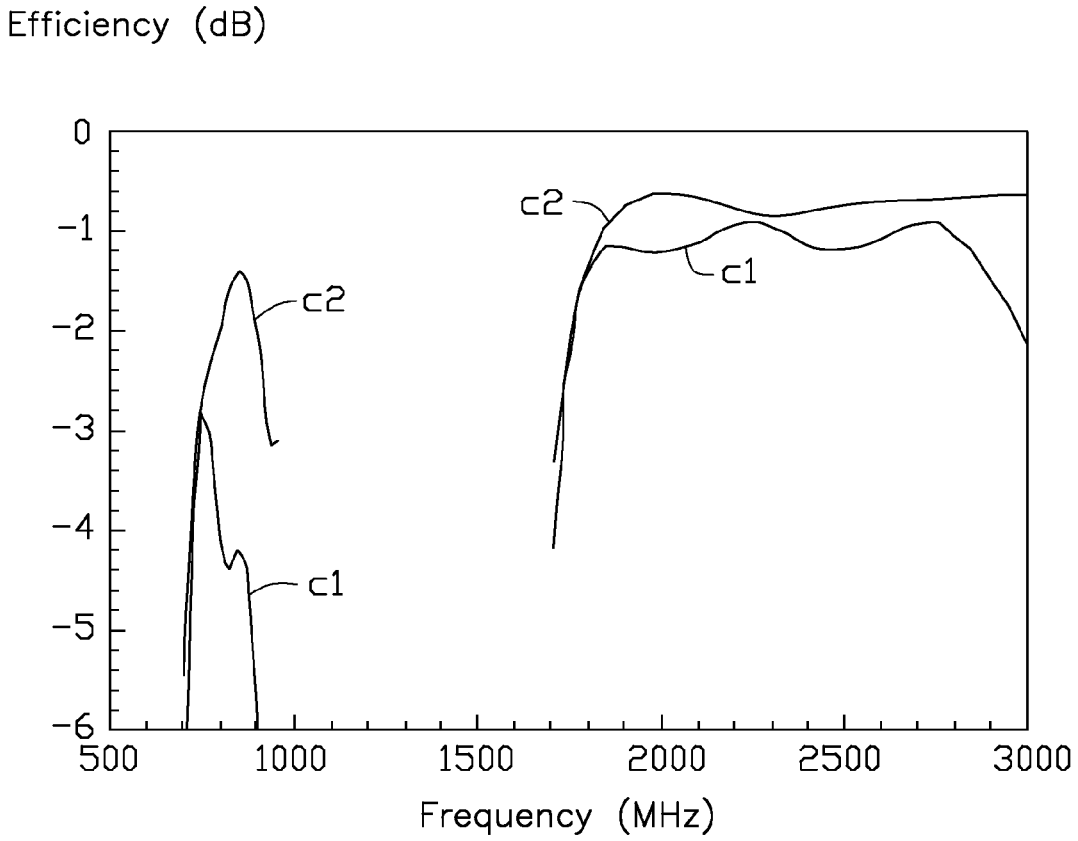
FIG. 5 is a second antenna efficiency diagram of the antenna assembly of FIG. 1.

FIG. 5 illustrates that a total efficiency and a radiating efficiency of the antenna assembly 100 when in aforesaid parameters. Line c1 represents a total efficiency of the antenna assembly 100; line c2 represents a radiating efficiency of the antenna assembly 100 correspondingly. FIG. 5 further illustrates that a radiating efficiency of the antenna assembly 100 in a frequency band of about 750-850 MHz is greater than −4 dB and in a frequency band of about 1710-2690 MHz is greater than −2 dB. Hence, the antenna assembly 100 achieves a great radiating efficiency for the wireless communication device 500 to meet different communication requirements.

Figure 6:
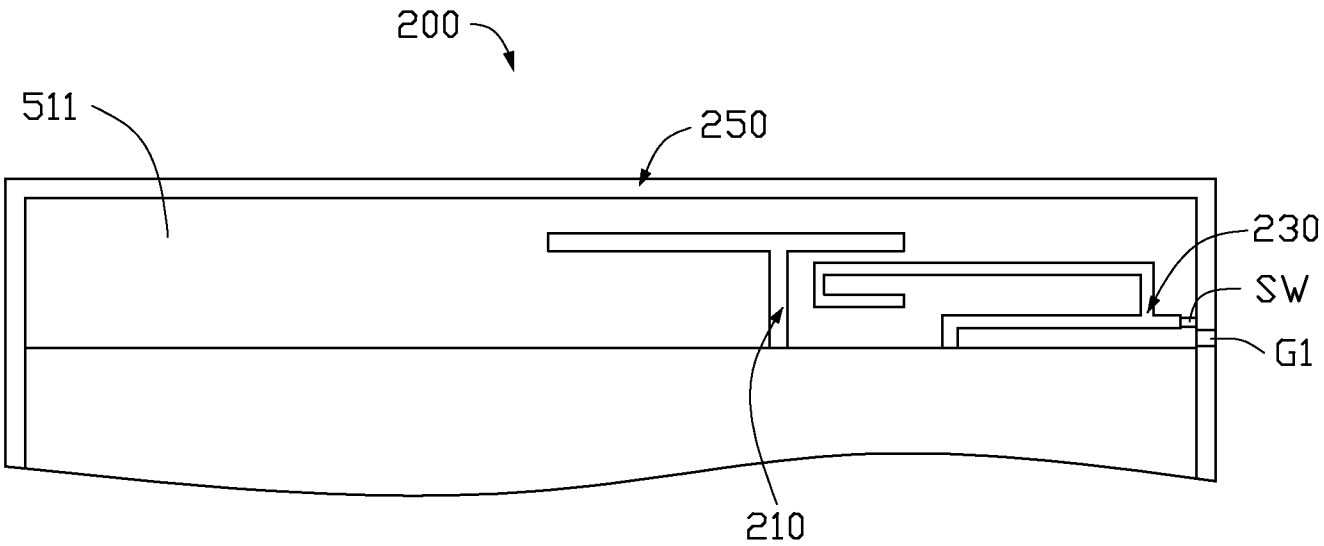
FIG. 6 is a diagrammatic view of a second embodiment of the antenna assembly.

FIG. 6 illustrates a second embodiment of an antenna assembly 200 including a first radiating portion 210, a second radiating portion 230, a third radiating portion 250, and a switch circuit SW. The first radiating portion 210 and the second radiating portion 230 have substantially similar structure as that in the first embodiment. The third radiating portion 250 only defines a first gap G1. In the second embodiment, the third radiating portion 250 can be a semi-frame shaped surrounding the clearance zoon 511.

Figure 7:
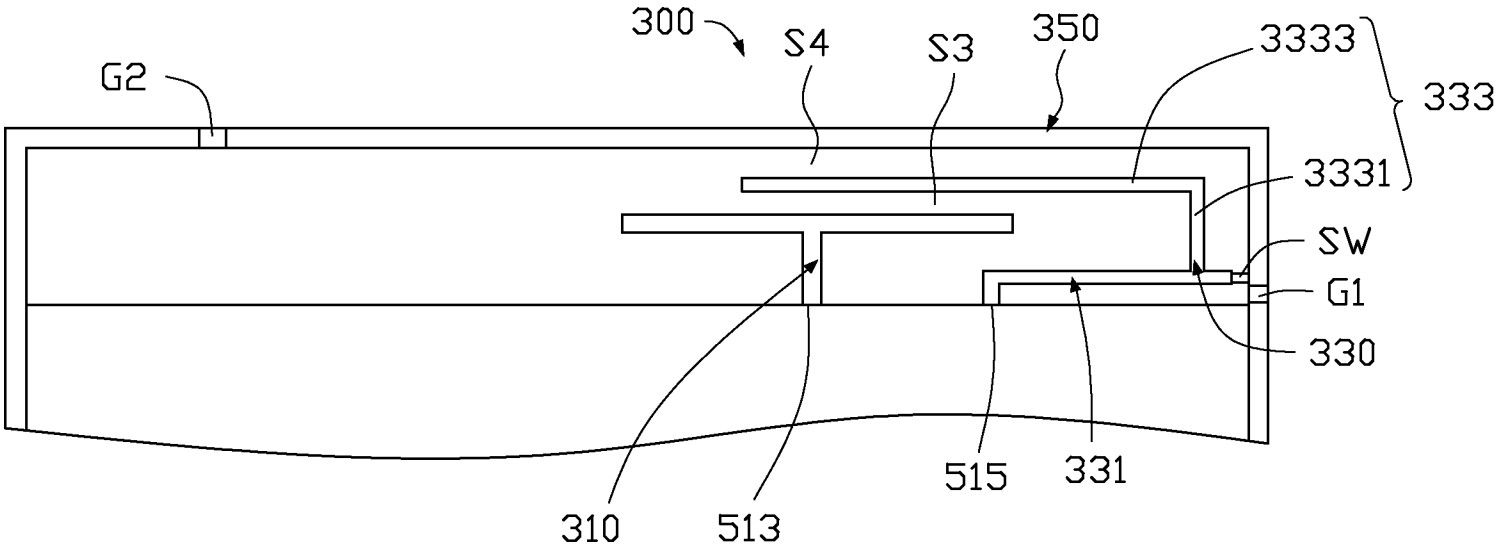
FIG. 7 is a diagrammatic view of a third embodiment of the antenna assembly.

FIG. 7 illustrates a third embodiment of an antenna assembly 300 including a first radiating portion 310, a second radiating portion 330, a third radiating portion 350, and a switch circuit SW. The first radiating portion 310 and the third radiating portion 350 have substantially similar structure as that in the first embodiment. The second radiating portion 330 includes a first radiating member 331 and a second radiating member 333. The first radiating member 331 has substantially similar structure as that in the first embodiment. The second radiating member 333 includes a first connecting section 3331 and a second connecting section 3333. The first connecting section 3331 is substantially perpendicularly connected to an end of the first radiating member 331 close to a first gap G1. The second connecting section 3333 is substantially perpendicularly connected to an end of the first connecting section 3331 away from the first radiating member 331, and extends towards the first radiating portion 310 and parallel to the third radiating portion 350. A third slot S3 is formed between the second connecting section 3333 and the first radiating portion 310, and a fourth slot S4 is formed between the second connecting section 3333 and the third radiating portion 350. In the third embodiment, the first radiating portion 310 and the second radiating portion 330 can be exchangeably connected to a feeding point 513 and a ground point 515, respectively.

Figure 8:
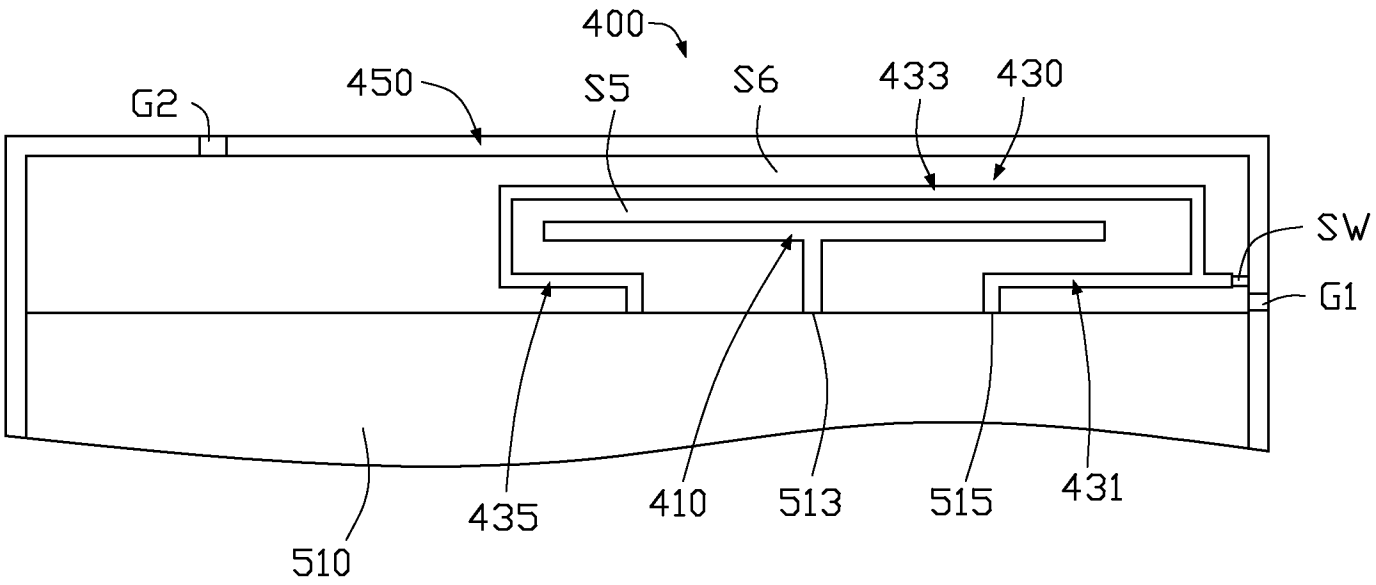
FIG. 8 is a diagrammatic view of a fourth embodiment of the antenna assembly.

FIG. 8 illustrates a fourth embodiment of an antenna assembly 400 including a first radiating portion 410, a second radiating portion 430, a third radiating portion 450, and a switch circuit SW. The first radiating portion 410 and the third radiating portion 450 have substantially similar structure as that in the first embodiment. The second radiating portion 430 includes a first radiating member 431, a second radiating member 433, and a third radiating member 435. The first radiating member 331 has substantially similar structure as that in the first embodiment. The third radiating member 435 and the first radiating member 431 are symmetrically arranged on two sides of the first radiating portion 410 and both are electrically connected to the base board 510. The second radiating member 433 is coupled between the first radiating member 431 and the third radiating member 435. A fifth slot S5 is formed between the second radiating member 433 and the first radiating portion 410, and a sixth slot S6 is formed between the second radiating member 433 and the third radiating portion 450.

The first radiating portion 10 couples to the second radiating portion 30 and the third radiating portion 50, and the switch circuit SW connected between the second radiating portion 30 and the third radiating portion 50 switches to different reactance Z to adjust the low frequency resonance mode of the antenna assembly 100, which render the antenna assembly 100 achieve a great radiating efficiency to meet communication requirements for the wireless communication device 200.

It is believed that the embodiments and their advantages will be understood from the foregoing description, and it will be apparent that various changes may be made thereto without departing from the scope of the disclosure or sacrificing all of its advantages, the examples hereinbefore described merely being illustrative embodiments of the disclosure.

What is claimed is:

1. An antenna assembly comprising:

a feeding point;

a first radiating portion electrically connected to the feeding point;

a second radiating portion electrically connected to a ground point and spaced apart from the first radiating portion; and a switch circuit electrically connected between the second radiating portion and a third radiating portion which is spaced from the first radiating portion, the switch circuit comprising a plurality of branch circuits each with different impedances;

wherein the first radiating portion and the second radiating portion are electrically coupled and configured to operate at a first frequency band; the first radiating portion, the third radiating portion, the switch circuit, and the second radiating portion are electrically coupled and configured to operate at a second frequency band; the switch circuit is configured to adjust a resonance mode of the antenna assembly by switching to different impedances;

wherein the first radiating portion is substantially a T-shaped monopole antenna and includes a first radiating section, a second radiating section, and a third radiating section; an end of the first radiating section is electrically connected to the feeding point, the other end is perpendicularly connected to the second radiating section and the third radiating section, the second radiating section and the third radiating section extend oppositely from the first radiating section;

wherein the second radiating portion comprises a first radiating member and a second radiating member, the first radiating member is substantially L-shaped and comprises a shorter section and a longer section, the shorter section is electrically connected to the ground point, the longer section is perpendicularly connected to the shorter section; and wherein the second radiating member comprises a first connecting section, a second connecting section, and a third connecting section; the first connecting section is substantially perpendicular to an end of the longer section away from the shorter section; the second connecting section is substantially perpendicular to an end of the first connecting section away from the longer section, the second connecting section extends towards the first radiating section and parallel to the third radiating section, and a first slot is formed between the second connecting section and the third radiating section; the third connecting section is substantially L-shaped and perpendicularly connected to the an end of the second connecting section close to the first radiating section, and extends towards the first connecting section and parallel to the second connecting section.

2. The antenna assembly as claimed in claim 1, wherein the third radiating portion defines first gap and a second gap and comprises a first antenna frame and a second antenna frame; the first frame is substantially L-shaped and includes a first frame section and a second frame section perpendicularly connected to the first frame section; the first gap is defined on an end of the first frame section, and the second gap is defined on an end of the second frame section; the second frame section, the second radiating section, and the third radiating section enclose a second slot; the second antenna frame is substantially L-shaped, one end of the second antenna frame is spaced from the first antenna frame via the second gap.

3. The antenna assembly as claimed in claim 2, wherein the switch circuit comprises a switching element and at least one reactance; the switching element comprises an input terminal and at least one output terminal; the input terminal is electrically connected to an end of the first frame section close to the first gap; one end of the at least one reactance is electrically connected the output terminal, and the other end is electrically connected to an end of the longer section.

4. The antenna assembly as claimed in claim 1, wherein the at least one reactance is a capacitor, an inductor, a resistor, or a combination of the capacitor, the inductor, and the resistor in serial or in parallel; the third radiating portion is electrically connected to the second radiating portion via a short circuit, the reactance, or the reactance combinations by switching the switching element.

5. The antenna assembly as claimed in claim 1, wherein the first connecting section is perpendicularly connected to an end of the first radiating member, the second connecting section is perpendicularly connected to an end of the first connecting section away from the first radiating member, and extends towards the first radiating portion and parallel to the third radiating portion; a third slot is formed between the second connecting section and the first radiating portion, and a fourth slot is formed between the second connecting section and the third radiating portion.

6. The antenna assembly as claimed in claim 1, wherein the third radiating member and the first radiating member are symmetrically arranged on two sides of the first radiating portion; the second radiating member is coupled between the first radiating member and the third radiating member; a fifth slot is formed between the second radiating member and the first radiating portion, and a sixth slot is formed between the second radiating member and the third radiating portion.

7. A wireless communication device comprising:

a base board defining a clearance zoon;

a metal frame surrounding the base board; and an antenna assembly comprising:

a feeding point arranged on the base board and adjacent to the clearance zoon;

a ground point arranged on the base board and adjacent to the clearance zoon;

a first radiating portion electrically connected to the feeding point;

a second radiating portion electrically connected to the ground point and spaced from the first radiating portion;

a third radiating portion being a portion of the metal frame and spaced from the first radiating portion; and a switch circuit electrically connected between the second radiating portion and the third radiating portion, the switch circuit comprising a plurality of branch circuits each with different impedances;

wherein the first radiating portion and the second radiating portion are electrically coupled and configured to operate at a first frequency band; the first radiating portion, the third radiating portion, the switch circuit, and the second radiating portion are electrically coupled and configured to operate at a second frequency band; the switch circuit is configured to adjust a resonance mode of the antenna assembly by switching to different impedances;

wherein the first radiating portion is substantially a T-shaped monopole antenna and includes a first radiating section, a second radiating section, and a third radiating section; an end of the first radiating section is electrically connected to the feeding point, the other end is perpendicularly connected to the second radiating section and the third radiating section, the second radiating section and the third radiating section extend oppositely from the first radiating section;

wherein the second radiating portion comprises a first radiating member and a second radiating member, the first radiating member is substantially L-shaped and comprises a shorter section and a longer section, the shorter section is electrically connected to the ground point, the longer section is perpendicularly connected to the shorter section; and wherein the second radiating member comprises a first connecting section, a second connecting section, and a third connecting section; the first connecting section is substantially perpendicular to an end of the longer section away from the shorter section; the second connecting section is substantially perpendicular to an end of the first connecting section away from the longer section, the second connecting section extends towards the first radiating section and parallel to the third radiating section, and a first slot is formed between the second connecting section and the third radiating section; the third connecting section is substantially L-shaped and perpendicularly connected to the an end of the second connecting section close to the first radiating section, and extends towards the first connecting section and parallel to the second connecting section.

8. The wireless communication device as claimed in claim 7, wherein the feeding point is electrically connected to a radio frequency transceiver circuit of the wireless communication device and configured to feed in signals for the antenna assembly; the ground point is electrically connected to a ground of the base board to provide grounding signals to the antenna assembly.

9. The wireless communication device as claimed in claim 8, wherein the metal frame defines a first gap and a second gap to divide the metal frame into a first antenna frame, a second antenna frame, and a third antenna frame; the first gap and the second gap are filled with nonconductive material; the first gap closes to the ground point and adjacent to an edge of the clearance zoon facing the base board; the second gap is adjacent to an edge of the clearance zoon away from the base board.

10. The wireless communication device as claimed in claim 9, wherein the third radiating portion defines first gap and a second gap and comprises a first antenna frame and a second antenna frame; the first frame is substantially L-shaped and includes a first frame section and a second frame section perpendicularly connected to the first frame section; the first gap is defined on an end of the first frame section, and the second gap is defined on an end of the second frame section; the second frame section, the second radiating section, and the third radiating section enclose a second slot; the second antenna frame is substantially L-shaped, one end of the second antenna frame is spaced from the first antenna frame via the second gap.

11. The wireless communication device as claimed in claim 10, wherein the switch circuit comprises a switching element and at least one reactance; the switching element comprises an input terminal and at least one output terminal; the input terminal is electrically connected to an end of the first frame section close to the first gap; one end of the at least one reactance is electrically connected the output terminal, and the other end is electrically connected to an end of the longer section.

12. The wireless communication device as claimed in claim 9, wherein the at least one reactance is a capacitor, an inductor, a resistor, or a combination of the capacitor, the inductor, and the resistor in serial or in parallel; the third radiating portion is electrically connected to the second radiating portion via a short circuit, the reactance, or the reactance combinations by switching the switching element.

13. The wireless communication device as claimed in claim 9, wherein the first connecting section is perpendicularly connected to an end of the first radiating member, the second connecting section is perpendicularly connected to an end of the first connecting section away from the first radiating member, and extends towards the first radiating portion and parallel to the third radiating portion; a third slot is formed between the second connecting section and the first radiating portion, and a fourth slot is formed between the second connecting section and the third radiating portion.

14. The wireless communication device as claimed in claim 9, wherein the third radiating member and the first radiating member are symmetrically arranged on two sides of the first radiating portion; the second radiating member is coupled between the first radiating member and the third radiating member; a fifth slot is formed between the second radiating member and the first radiating portion, and a sixth slot is formed between the second radiating member and the third radiating portion.

* * * * *